US006223381B1

(12) United States Patent
Brown, Jr.

(10) Patent No.: US 6,223,381 B1
(45) **Date of Patent: *May 1, 2001**

(54) MOP

(76) Inventor: Arthur King Brown, Jr., 2036 Greenleaf Blvd., Elkhart, IN (US) 46514

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/350,409

(22) Filed: Jul. 6, 1999

Related U.S. Application Data

(63) Continuation-in-part of application No. 09/049,585, filed on Mar. 27, 1998, now abandoned.

(51) Int. Cl.[7] ..... A47L 13/144

(52) U.S. Cl. ..... 15/119.2; 15/244.1; 15/98

(58) Field of Search ..... 156/92, 257, 258, 156/293; 144/346, 347, 369; 15/119.1, 119.2, 98, 244.1; 29/895.22; 44/166

(56) References Cited

U.S. PATENT DOCUMENTS

| | | | | |
|---|---|---|---|---|
| 3,253,290 | * | 5/1966 | Powers . | |
| 4,875,246 | * | 10/1989 | MacGregor | 15/98 |
| 5,381,579 | * | 1/1995 | Sartori | 15/119.2 |
| 5,512,121 | * | 4/1996 | Brown, Jr. | 15/115 |
| 5,596,786 | * | 1/1997 | Kluiters | 15/119.2 |

* cited by examiner

*Primary Examiner*—Sam Chuan Yao
(74) *Attorney, Agent, or Firm*—Leo H. McCormick, Jr.

(57) ABSTRACT

A method of manufacturing a mop wherein a cylindrical member is fixed in a groove of a sponge. The cylindrical member has a smaller length than the sponge and a flat surface located midway between a first end and second ends thereof. The flat surface is located in a same horizontal plane as first and seconds lands defined by the groove in the sponge. A single screw is turned into the cylindrical member at the center of the flat surface and a handle is turned onto the screw until an end of the handle engages the flat surface. A roller with a smaller diameter than the diameter of the cylindrical member has a first axial projection, which is located in a first opening in a strap, and a second axial projection which is in a second opening in the strap. The strap is flexed and the first and second axial projections on the cylindrical member are located in third and fourth openings in the strap such that the roller and cylindrical member are parallel to each other. The roller is retained in first and second rest positions by being positioned on one of the first and second lands of the sponge. The strap is adapted to rotate in an arc about the first and second projections on the cylindrical member from a first rest position to a second rest position. On rotation, the sponge is radially compressed between the roller and cylindrical member and axially compressed between the strap, roller and cylindrical member to remove liquid from the sponge. The diameter of the roller and a space relationship between the first and third and second and fourth openings in the strap assure that the roller is positioned on the first land in the first rest position and on the second land in the second rest position as the strap is rotated about the cylindrical member.

4 Claims, 4 Drawing Sheets

FIG. 10
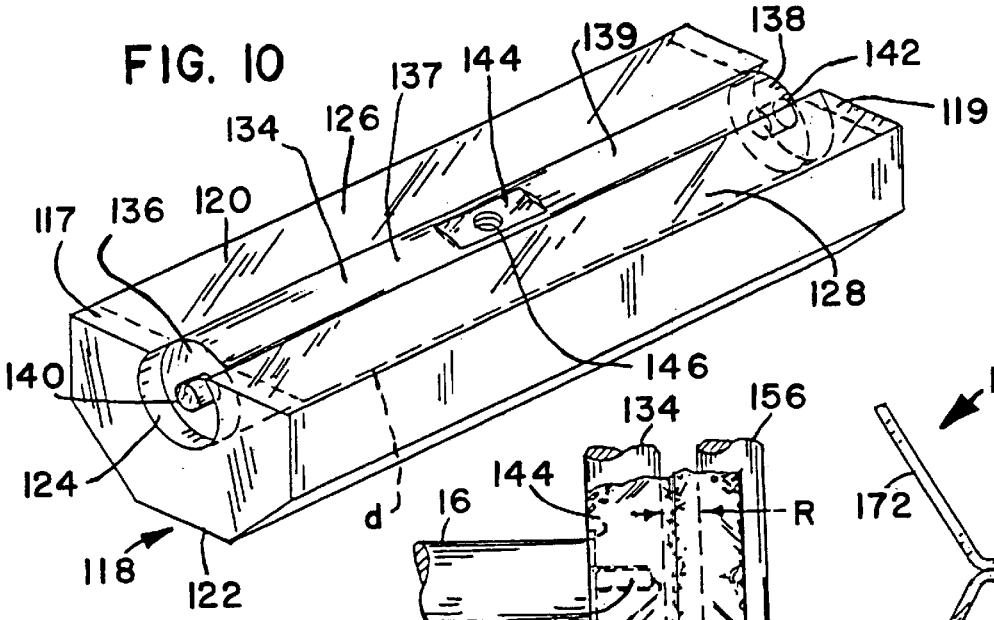
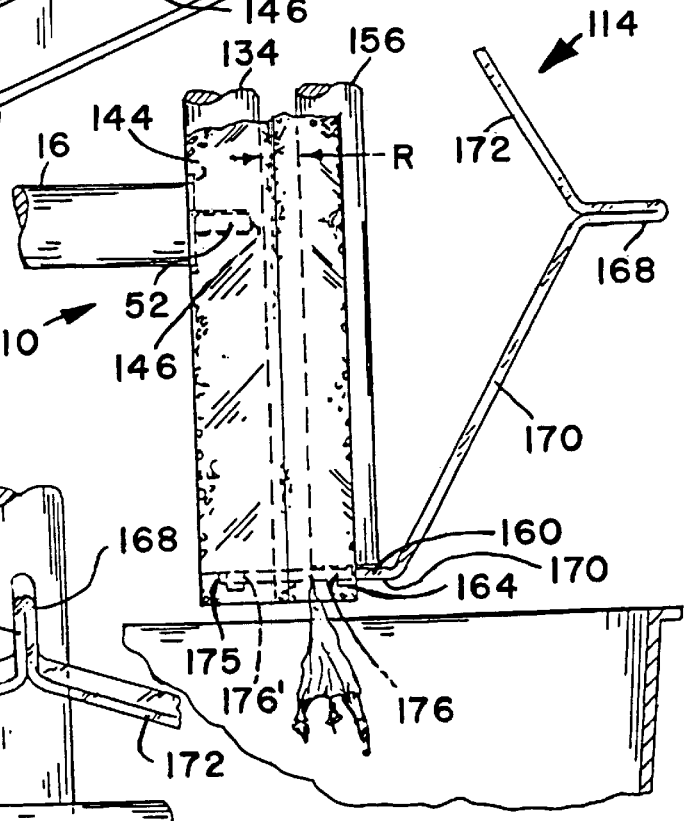
FIG. 12
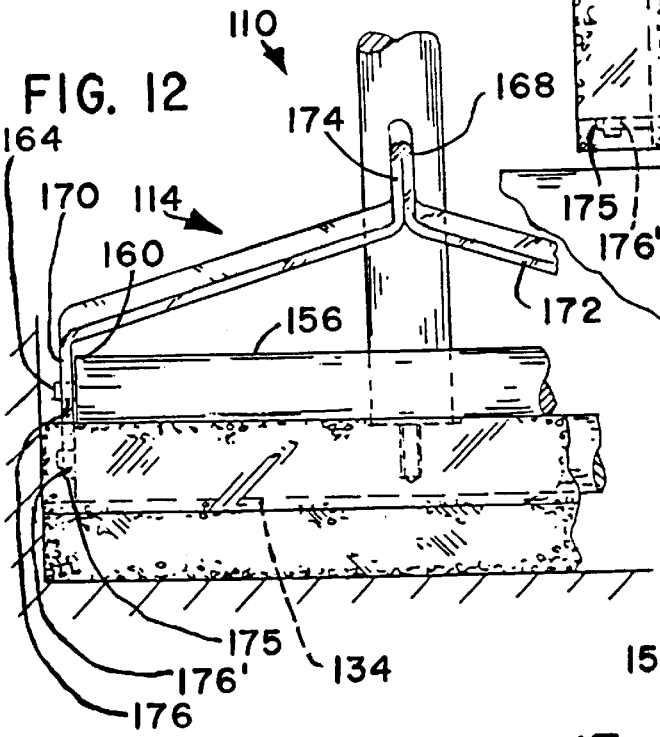
FIG. 11
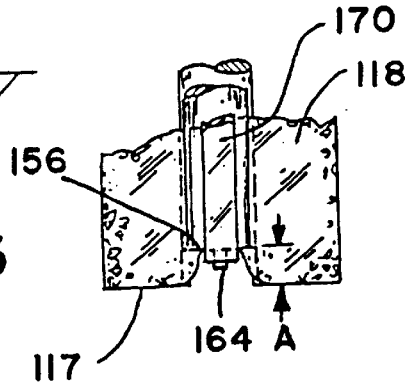
FIG. 13

MOP

This is a Continuation-in-Part of application Ser. No. 09/049,585 filed Mar. 27, 1998 now abandoned.

This invention relates to a method of manufacturing a mop and in particular a head for a mop wherein first and second lands on a top surface of a sponge hold a wringer against a handle.

BACKGROUND OF THE INVENTION

U.S. Pat. No. 5,512,121 discloses a method of manufacturing a mop having a head made from a rectangular open cell sponge attached to a cylindrical core. This method of manufacturing a mop will produce an acceptable product however it is important that the space relationship between the cylindrical member, which carries the sponge and roller, be maintained within a critical tolerance. If this tolerance is not maintained moisture will not be removed from the sponge in a desired manner and when the roller is moved between the first and second rest positions the roller will not be positioned on the appropriate land formed on the top of the sponge. Thus, the internal resiliency of the sponge will not hold the roller against the handle.

SUMMARY OF THE INVENTION

A primary object of the present invention is to provide a method of manufacturing a mop wherein a roller is retained on a land in a rest position and resiliently urged into engagement with a handle.

According to the method disclosed herein a sponge having a desired shape with a top surface separated from a bottom surface by a predetermined uniform thickness is located in a fixture. The sponge has a longitudinal groove that extends from the top surface to a predetermined depth to define first and second lands on the top surface. A cylindrical member with an adhesive applied thereto is located in the groove such that a flat surface located adjacent a midpoint between first and second ends is located in a same plane as the top surface of the sponge. The sponge has a length, which is longer than the axial length of the first cylindrical member. A fastener member screwed into the cylindrical member at the midpoint of said first and second ends is located in a plane perpendicular to the cylindrical member. A handle is screwed onto the fastener until a first end of the handle engages the flat surface. A roller obtained from a source of supply has a second diameter of approximately three/fourths the first diameter of the first cylindrical member is connected to a strap by locating first and second projections of the roller in corresponding first and second openings in the strap. The strap is joined to the cylindrical member by locating first and second projections on the cylindrical member in corresponding third and fourth openings in the strap such that the roller is parallel to the cylindrical member. The strap rotates in an arc about the axis of the cylindrical member from a first rest position to a second rest position. On rotation, a radial force is produced between the roller and cylindrical member while an axial force is produced between the strap, roller and cylindrical member to compresses the sponge and remove liquid therefrom. The roller is retained in the first and second rest positions by being located on one of the first and second lands. The second diameter of the roller and a space relationship between the first and third and second and fourth openings on the strap assuring that the roller is positioned on the first land in the first rest position and on the second land in the second rest position as the strap is rotated about the axis of the cylindrical member.

An advantage of the method of manufacture of a mop by this invention occurs in the alignment of a flat on the cylindrical body of a sponge with a top surface of the sponge to assure that substantially all moisture is removed from the sponge as the sponge is rotated in an arc around the axis of the cylindrical body between first and second rest positions.

A further advantage of this mop is provided by the roller and strap which combine to respectively axially and radially compress a sponge to remove liquid on rotation of the strap from a first rest position to a second rest position.

BRIEF DESCRIPTION OF THE DRAWINGS

FIG. 10 is a prospective view of a sponge attached to a cylindrical member of FIG. 2, the sponge having a length greater than the axial length of the cylindrical member;

FIG. 11 is a view of a mop illustrating the functional operation a sponge of FIG. 10;

FIG. 12 is a view illustrating the use of the mop of FIG. 11 with respect to a wall; and FIG. 13 is a partial view illustrating the relationship between the strap an sponge of FIG. 11.

DETAILED DESCRIPTION

Figure 5:
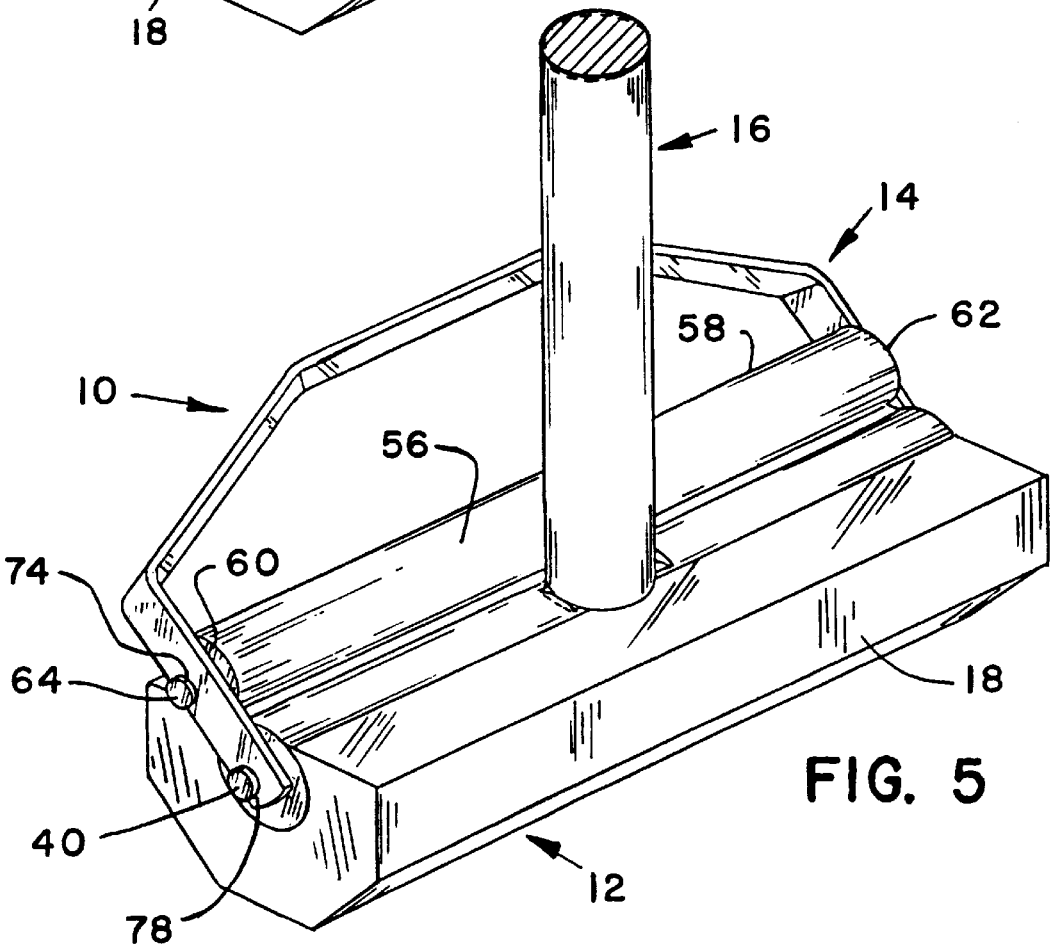
FIG. 5 is a prospective view of the mop of FIG. 4 with a wringer.

The mop 10 illustrated in FIG. 5 is essentially composed of a sponge member 12, a wringer 14 assembly and a handle 16. The mop 10 is manufactured according the following steps.

Figure 1:
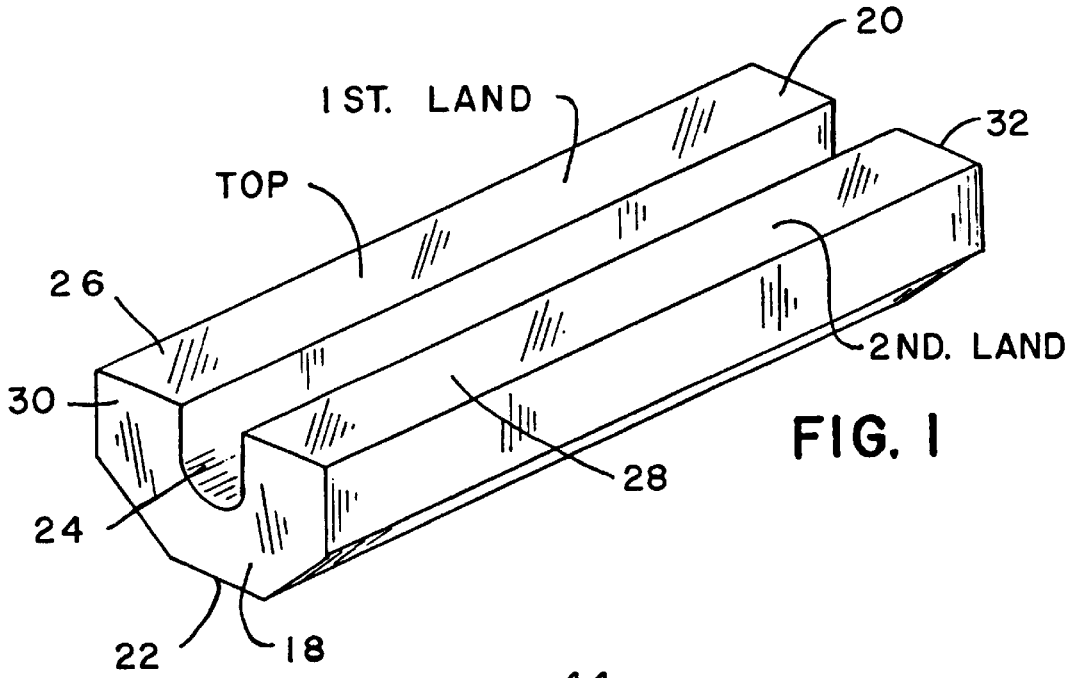
FIG. 1 is a prospective illustration of a sponge having a desired shape for use in the mop disclosed herein.

A sponge 18 having a desired shape is obtained from a source. The sponge 18, as shown in FIG. 1, has a substantially rectangular shape with a top surface 20 separated from a bottom surface 22 by a predetermined uniform thickness. The sponge 18 has a longitudinal groove 24 that extends from a top surface 20 to a predetermined depth to define first 26 and second 28 lands that extend from a first end 30 to a second end 32 on the top surface 20. The sponge 18 is placed in a fixture and a cylindrical member attached thereto to define the sponge member 12.

Figure 2:
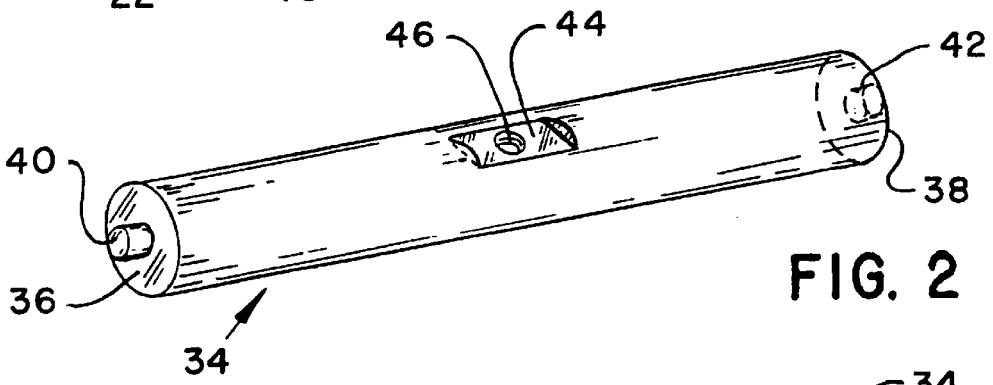
FIG. 2 is a prospective illustration of a cylindrical member for use in the mop disclosed herein.

A cylindrical member 34 is obtained from a source of supply. The cylindrical member 34, as shown in FIG. 2, has a uniform first diameter that extends from a first end 36 to a second end 38. The cylindrical member 34 has a first axial projection 40 that extends from the first end 36 and a second axial projection 42 that extends from the second end 38 and a flat surface 44 adjacent a midpoint 46 of the first 36 and second 38 ends. The cylindrical member 34 is made from a single molded part.

Figure 3:
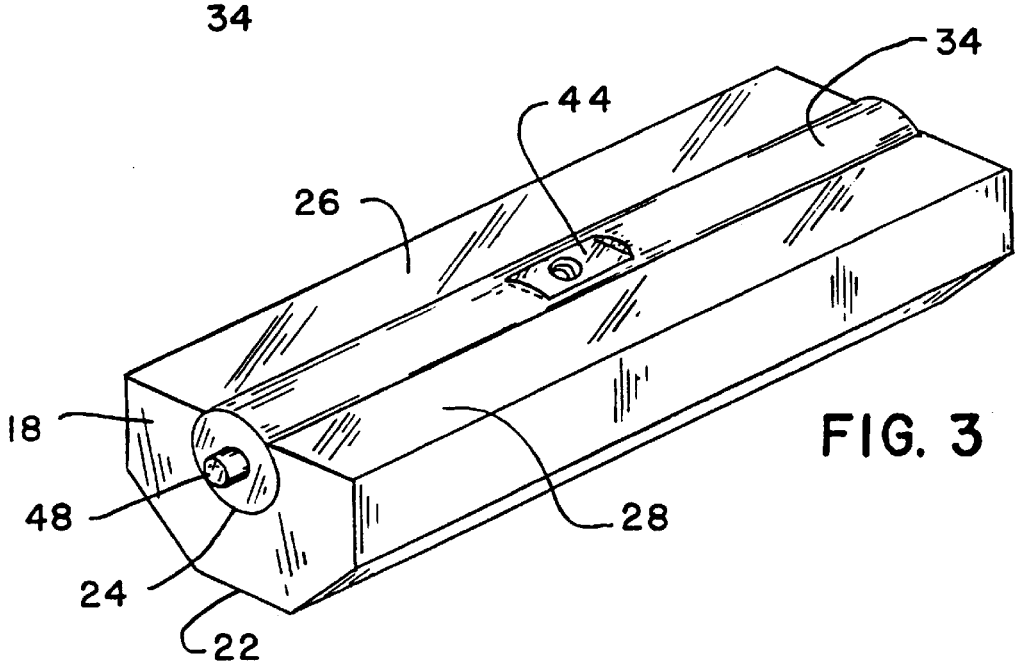
FIG. 3 is a prospective illustration of the sponge of FIG. 1 with the cylindrical member of FIG. 2 attached thereto.
Figure 7:
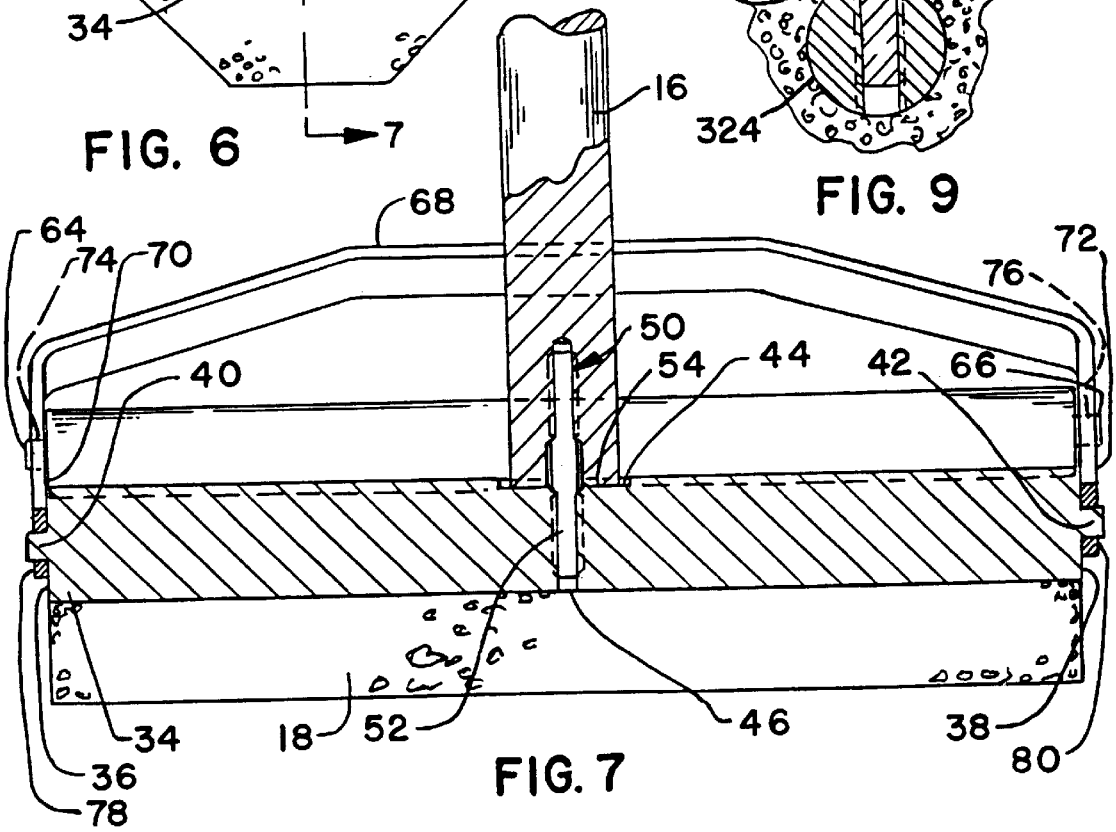
FIG. 7 is a sectional view taken along lines 7—7 of FIG. 6 illustrating the single attachment screw.

An adhesive coating 48 is applied to the cylindrical member 34 and the cylindrical member 34 is placed in the longitudinal groove 24 to secure the cylindrical member 34 to the sponge 18, see FIGS. 3 and 7. The cylindrical member 34 has a diameter greater than the predetermined depth of the groove 24 such that an arcuate section of the cylindrical member 34 extends above the top surface 20. The cylindrical member 34 is aligned in the groove 24 such that the flat surface 44 is in a same horizontal plane as lands 26 and 28 on the top surface 20 of the sponge 18.

A fastener member 50, as best shown in FIG. 7, has a single screw 52, which is turned into the cylindrical member 34 at the midpoint 46 of the first 36 and second 38 ends. The fastener member 50 is located in a plane perpendicular to the cylindrical member 34.

Figure 9:
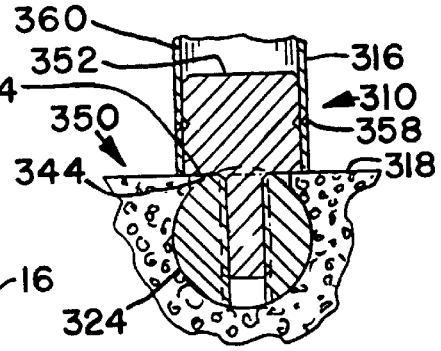
FIG. 9 is a sectional view illustrating structure for attaching a tubular handle to the cylindrical structure.

The handle 16 is attached to the fastener member 50 such that a first end 54 engages the flat surface 44. The handle 16 is typically made from a single member as illustrated in FIGS. 5 and 7 but could be made of a tube as illustrated in FIG. 9.

Figure 4:
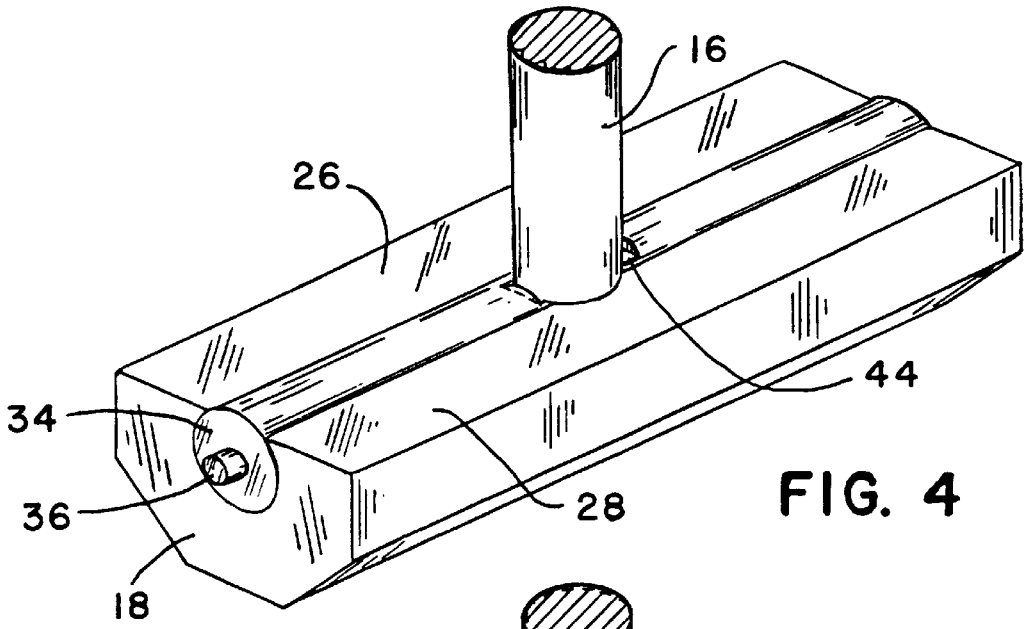
FIG. 4 is a prospective view of the sponge of FIG. 3 with a handle secured thereto to define a mop.

Once the handle 16 is attached to cylindrical member 34 as shown in FIG. 4, a roller 56 is obtained from a source of supply to initiate the subassembly for the wringer 14.

Figure 6:
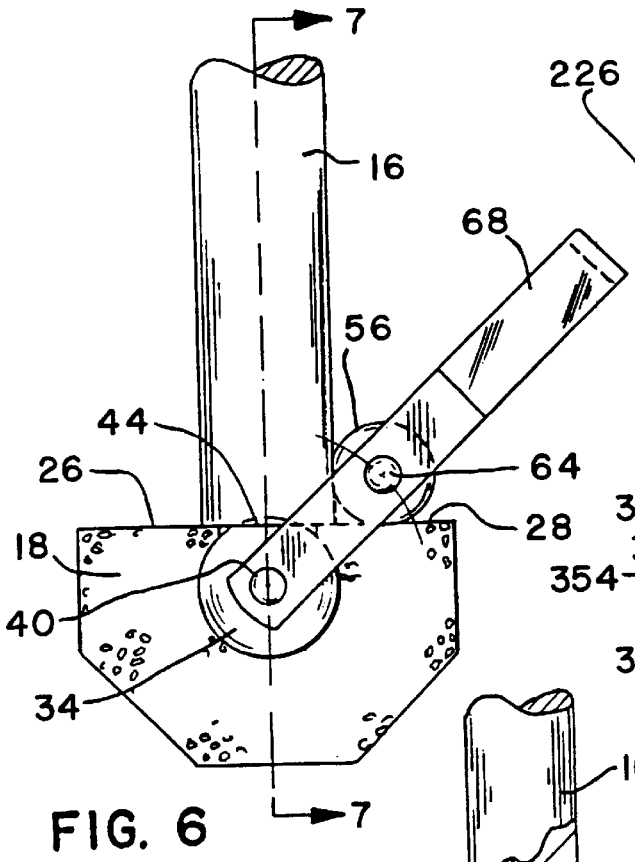
FIG. 6 is a side view of the mop of FIG. 5.

Roller 56 for wringer 14 has a second diameter 58 that extends from a first end 60 to a second end 62. As best shown in FIGS. 6 and 7, the diameter 58 of roller 56 is approximately three/fourths the diameter of cylindrical member 34. Roller 56 has first 64 and second 66 projections that extend from its axis. Roller 56 is typically made from an injection molding process but could be made from a tubular component with an axle located on its axis.

Roller 56 is connected to a strap 68 by flexing a first end 70 of the strap 68 away from a second end 72 to locate the first projection 64 in a first opening 74 and the second projection 66 in a second opening 76.

Thereafter, the strap 68 and attached roller 56 is connected to the cylindrical member 34 by the following flexing procedure. The first end 70 is flexed away from the second end 72 and the first projection 40 on cylindrical member 34 is located in opening 78 and the second projection 42 is located in opening 80 such that roller 56 and cylindrical member 34 are aligned in a parallel relationship to compete the assembly of the wringer 14 with the sponge 16 as shown in FIG. 5. With the flat surface 44 and first 26 and second 28 lands in a same plane, roller 56 is retained in a rest position with wringer 14 located adjacent handle 16.

Figure 8:
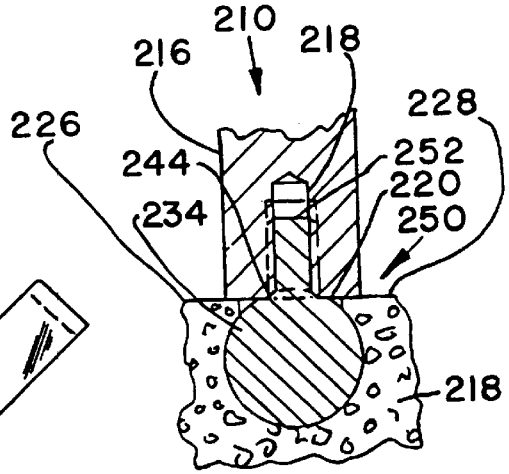
FIG. 8 is a sectional view illustrating alternate attachment for the handle and cylindrical core of the mop of this invention.

For some applications, it may be desirable for the fastener 250 of a mop 210 to be molded into the cylindrical member 234 as shown in FIG. 8. In this instance the screw 252 projects from the midpoint of the cylindrical member 234 and handle 216 has an opening 218 for receiving screw 252. The assembly being essentially identical as with mop 10 in that end 220 of handle 216 is brought into engagement with flat 244 which is located in same plane as lands 226 and 228 on the top of sponge member 212.

In an effort to simplify the manufacture of a mop 310, the fastener 350 is composed of a plug 352, which is screwed into cylindrical member 324 as shown in FIG. 9. Face 354 on plug 352 engages flat surface 344 to locate a groove 358 in a corresponding groove 358' a fixed height above flat surface 344. A tube 360 is located over plug 352 and indented or crimped into groove 358 to fix handle 316 in a plane perpendicular to the cylindrical member 324.

The second diameter 58 of roller 56 and a space relationship between said first 74 and third 78 and second 76 and fourth 80 openings on strap 68 are critical to assure that roller 56 is positioned on the first land 28 in the first rest position and on the second land 30 in the second rest position.

In the embodiment of the mop 110 shown in FIGS. 11 and 12 a change has been made to accommodate for a further removal of liquid from a sponge 118 by both axially and radially compressing the sponge 118 on rotation of the wringer 114 in an arc about cylindrical member 134.

In the manufacture of mop 110, a sponge 118 having a rectangular shape with a desired first length is obtained from a source and placed in a fixture. Sponge 118 has a desired shape with a top surface 120 separated from a bottom surface 122 by a uniform thickness and a longitudinal groove 124 that extends from top surface 120 to a fixed depth "d" to define first 126 and second 128 lands on the top surface 120.

A cylindrical member 134 is obtained from a source of supply and located in groove 124. Cylindrical member 134 has a uniform first diameter with a second length that extends from a first end 136 to a second end 138. A first axial projection 140 extends from the first end 136 and a second axial projection 142 extends from the second end 138. Cylindrical member 134 has a flat surface 144 at the midpoint between the first 136 and second 138 ends. An adhesive is applied to the cylindrical member 134 and the cylindrical member 136 is placed in the longitudinal groove 124 to secure the cylindrical member 134 to the sponge 118. Cylindrical member 134 has a diameter greater than the fixed depth "d" of longitudinal groove 124 and as result first 137 and 139 arcuate sections of the cylindrical member 134 extend above the top surface 120 of sponge 118 while flat surface 144 is aligned in a same horizontal plane as the top surface 120. The midpoint of sponge 118 is aligned with the midpoint of cylindrical member 134 such that first 117 and second 119 end portions of sponge 118, see dashed lines, extends past the first 136 and second 138 ends of cylindrical member 134, see FIG. 10.

A handle 16 is attached to cylindrical member 134 by a screw 52 being screwed into cylindrical member 134 at midpoint 146 such that an end of the handle engages flat surface 144 as best shown in FIG. 11.

A roller 156 is obtained from a source of supply. Roller 156 has a diameter that extends from a first end 160 to a second end (not shown). The diameter of roller 156 is smaller than the diameter of cylindrical member 134 while length of the roller 156 is substantially equal to the length of the cylindrical member 134. The roller 156 has first 164 (only one is shown) and second projections that respectively extend from the first 160 and second ends thereof.

Roller 156 is connected to wringer 114 for attachment to cylindrical member 134. Wringer 114 has a strap 168 which has parallel first 170 and second 172 sides connected to a center member 174. The first side 170 has a first plurality of openings 176,176' openings located therein at a fixed distance from a first end 175 and the second side is identical to the first side and although not shown it has a second plurality of openings located therein at a fixed distance from a second end. Strap 168 is flexed and projection 164 on the first end 160 of roller 156 is located in opening 176 of side 170 and the projection on the second end is located in a corresponding opening in side 172 such that roller 156 is parallel to cylindrical member 134.

Strap 168 is flexed again and the first end 175 is moved with respect to a second end to allow the first 140 and second 142 projections on cylindrical member 134 to be respectively located in corresponding openings 176', only one of which is shown FIGS. 11 and 12. Sides 170 and 172 of the strap 168 respectively engage the first 117 and second 119 portions of sponge 118 that extend past the first end 136 and second end 138 of cylindrical member 134.

Wringer 114 is adapted to rotate in an arc about the first 140 and second 142 projections of cylindrical member 134 from a first rest position defined by land 126 to a second rest position defined by land 128 on top surface 120. As wringer 114 is rotated, sponge 118 is radially compressed between roller 156 and cylindrical member 134 to a depth "R" as best shown in FIG. 11 while sponge 118 is axially compressed between the first 170 and second sides 172 of strap, roller 156 and cylindrical member 134 to a depth "A" as shown in FIG. 13 to remove liquid therefrom.

Mode of Operation of the Invention

When a person desires to operate the mop 10, sponge 18 is moistened with a liquid and wringer 14 rotated in an arc about the axis of cylindrical member 34 from a first rest position to a second rest position. As wringer 14 is rotated, roller 56 moves a wall of liquid to remove any liquid from sponge 18. The roller 56 when reaching an angle of approximately 45 degrees with respect to handle 16 has moved past lands 26 or 28 and is retained in the first and second rest positions by resting on one of the first 26 and second 28 lands.

When a mop 110 having a sponge 118 is used, portions 117 and 119 of sponge 118 which extend past the corresponding ends 136 and 138 of the cylindrical member 134 allows engagement with walls and corners without interference of strap 156.

I claim:

1. A mop comprising:

a sponge having a first length with a rectangular shape, said rectangular shape having a top surface separated from a bottom surface and a longitudinal groove that extends from said top surface to a fixed depth to define a uniform thickness from said groove to said bottom surface;

a cylindrical member located in said longitudinal groove and having a first diameter with a second length that extends from a first end to a second end, said cylindrical member having a first axial projection that extends from said first end and a second axial projection that extends from said second end, said cylindrical member having a flat surface at a first midpoint located between said first and second ends, said second length of said cylindrical member plus a length for each of said first and second axial projections being less than said first length of said sponge, said cylindrical member having a diameter greater than said depth of said longitudinal groove such that first and second arcuate sections of said cylindrical member extend above said top surface of said sponge while said flat surface is aligned in a same horizontal plane as said top surface of said sponge;

an adhesive for attaching said sponge to said cylindrical member such that said first midpoint of said cylindrical member is aligned in a same vertical plane with a second midpoint of said sponge such that first and second portions of said sponge respectively extend past said first and second first and second axial projections;

a handle having a first end attached to said flat surface of said cylindrical member;

a strap having parallel first and second sides connected to a center member, said first side having a first end with first and second openings located therein at a fixed distance from said first end, said second side having a second end with third and fourth openings located therein at a fixed distance from said second end; and a roller having a second diameter with a third length that extends from a first end to a second end, said second diameter of said roller being smaller than said first diameter of said cylindrical member while said third length is substantially equal to said second length, said roller having a first projection that extends from said first end and is located in said second opening in said strap and a second projection that extends from said second end and is located in said fourth opening in said strap, said strap being joined to said cylindrical member by locating said first projection on said cylindrical member in said first opening of said strap and said second projection on said cylindrical member in said third opening of said strap such that said roller is parallel to said cylindrical member and said first and second sides of said strap are perpendicular to said cylindrical member, said strap being adapted to rotate in an arc about said first and second projections on said cylindrical member from a first rest position to a second rest position, said roller on rotation of said strap radially compressing said sponge while said first and second sides of said strap correspondingly engage said first and second portions of said sponge to axially compresses said sponge to remove liquid from said sponge.

2. The mop as recited in claim 1 wherein said second diameter of said roller and a space relationship between said first and third and second and fourth openings on said strap assure that said roller is positioned on said top surface of said sponge in said first and second rest positions as said strap is rotated about said cylindrical member.

3. The mop as recited in claim 1 wherein said first length of said sponge, said second length of said cylindrical member, said third length of said roller and said strap create a relationship to define a length for each of said first and second portions of said sponge which correspondingly extend past said first and second ends of said strap and allow said first and second portions of said sponge to engage an object without interference with said first and second ends of said strap.

4. The mop as recited in claim 3 wherein said first and second ends of said strap axial compress said first and second portions of said sponge such that a length of said sponge adjacent said first and second ends is substantially equal to said second length of said cylindrical member an said rotation of said strap from said first rest position to said second rest position.

* * * * *